United States Patent [19]

Hilbrands

[11] 4,150,779

[45] Apr. 24, 1979

[54] BOX CONSTRUCTION

[75] Inventor: Hans A. Hilbrands, Westervelde, Netherlands

[73] Assignee: U.S. Philips Corporation, New York, N.Y.

[21] Appl. No.: 841,591

[22] Filed: Oct. 12, 1977

Related U.S. Application Data

[63] Continuation of Ser. No. 687,665, May 19, 1976, abandoned.

[30] Foreign Application Priority Data

Jun. 2, 1975 [NL] Netherlands ..... 7506496

[51] Int. Cl.[2] ..... B65D 5/66; B65D 25/14

[52] U.S. Cl. ..... 229/44 R; 150/0.5; 220/334; 220/468

[58] Field of Search ..... 229/44; 220/334, 342, 220/343, 63 R; 150/0.5; 190/41 R, 53, 54

[56] References Cited

U.S. PATENT DOCUMENTS

| | | | |
|---|---|---|---|
| 799,844 | 9/1905 | Fuller | 220/334 |
| 1,283,749 | 11/1918 | Hauer | 220/334 |
| 2,490,746 | 12/1949 | Carpenter, Jr. | 220/334 |
| 2,509,462 | 5/1950 | Vogel | 220/334 |
| 2,697,537 | 12/1954 | Wetherell | 220/342 |
| 3,698,594 | 10/1972 | Boehlert | 220/63 R |

*Primary Examiner*—William Price
*Assistant Examiner*—Steven M. Pollard
*Attorney, Agent, or Firm*—William J. Streeter; Rolf E. Schneider

[57] ABSTRACT

A box is provided with pivotally connected upper and lower parts, and a dish member having a vertically arranged peripheral wall in the lower box part. A portion of such peripheral wall extends vertically above the lower box part for a distance to conceal the pivotal connection from view when the box is in an open condition.

1 Claim, 2 Drawing Figures

BOX CONSTRUCTION

This is a continuation, of application Serial No. 687,665, filed May 19, 1976 now abandoned. "Improvements in or relating to boxes".

This invention relates to a box having two pivotally connected parts which are movable relative to each other over a pivot angle smaller than 120°, a dish member portion being as secured in one box part and engaging, over the greater part of its circumferential edge remote from the bottom of the one box part, the circumferential edge of such box part, the box including means arranged to conceal the hinge pin and/or the pivotally co-operating edges of the box parts in the open condition of the box. Such a box is known and may be used, for example, as a luxury container for holding, for example, an electric shaving apparatus.

The known box is formed from two halves which are pivotally connected together. In the known box, means are included by which the hinge pin and/or the pivotally co-operating edge portions of the box are hidden from view in the open condition of the box. Said means comprises a strip of flexible material which is pleated and which is associated with the hinge parts being located on either side of the hinge pin in the free spaces between each box part and the dish portion secured therein. Said strip hides the hinges and the pivotally cooperating edge portions. This construction requires the provision of an extra component which requires additional assembly time and causes an increase in the cost-price of the box.

It is an object of the invention to provide a type of box in which the provision of such an extra component may be avoided.

For that purpose, the box according to the invention is characterized in that the said means are provided by the projection of one dish portion edge, over at least the length of the pivotally co-operating box parts, about its associated box part in a direction perpendicular to the bottom of such box part.

Although essentially only one dish portion need have this projecting edge, a box construction is preferred in which each box part is provided with a dish portion having such a projecting edge. Such an embodiment is characterized in that the dish portion associated with the other box part also projects over at least the length of the hinge pin and/or the pivotally co-operating edges of the box parts above the other box part in a direction perpendicular to the bottom of said other box part. This other projecting edge in the open position of the box is situated a short distance from the projecting edge of the first dish portion and, in the closed position of the box, extends into a slot-like space sent between the side wall of the first box part adjacent the hinge pin and the dish portion of said box part near said wall. In this manner the hinged edge of the box can be given an attractive finish.

By way of example, an embodiment of the invention will be described in greater detail with reference to the accompanying drawing, in which.

Figure 1:
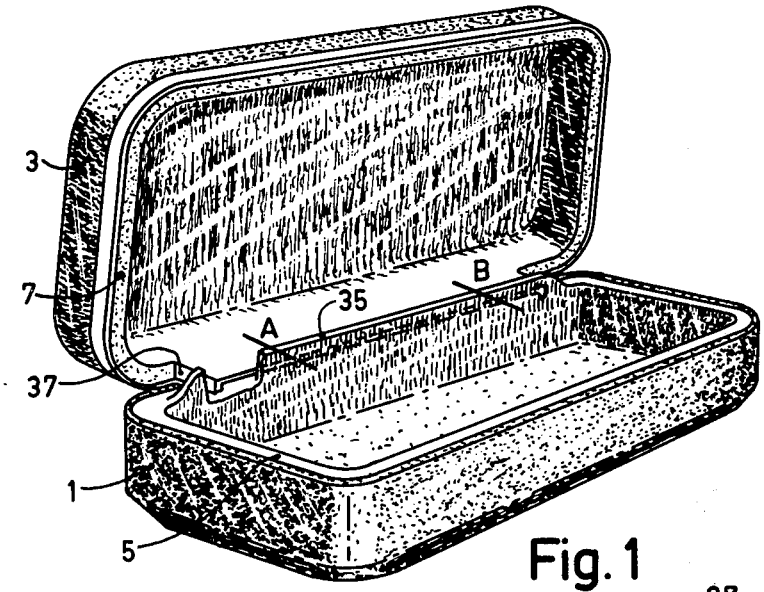
FIG. 1 shows the box of the invention in an open condition.
Figure 2:
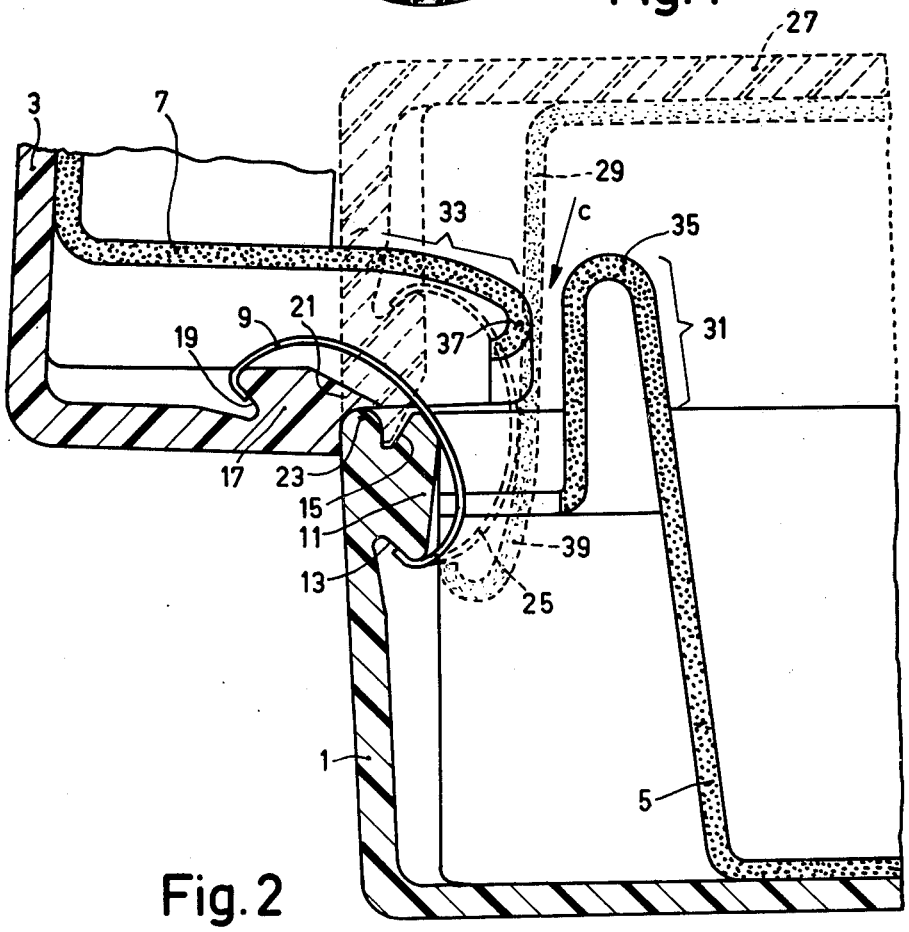
FIG. 2 is an enlarged sectional view of the box, taken transverse to the direction of pivoting.

The box of the invention comprises two parts 1 and 3 both manufactured from a synthetic resin. Dish portions 5 and 7 forming inserts are secured in the box parts 1 and 3. Said dish portions 5 and 7 are manufactured in a suitable shock-absorbing thin-walled form from a synthetic resin material. The parts 1 and 3 are pivotally connected together in each of the places denoted by A and B by means of a resilient brace 9. For that purpose the part 1 has in the places A and B a thickened portion 11 which includes grooves 13 and 15. The box part 3 comprises a thickened portion 17 which includes a groove 19 and a curved nose portion 21 which co-operates with the rounded edge 23 of the box part 1. The brace 9 which is in the form of a leaf spring hooks behind the grooves 13 and 19. Said brace 9 keeps the box parts in a fixed, open or closed condition. In the closed condition of the box the part 3 is in the position shown by the broken-lines in FIG. 2. In the closed condition the brace is denoted by reference 25. In that condition the box part 3 and the dish portion 7 are denoted by references 27 and 29.

In order to hide the brace 9 and the greater part of the edges of the parts 1 and 3 co-operating with each other, which parts are otherwise visible in the open condition of the box, a thin flexible cover formed by a piece of synthetic material has been used hitherto. The cover usually extends along the whole length of the co-operating edges of the parts 1 and 3, and is folded around the braces 9 to conceal the free space between the box part 1 and the dish portion 5 and the free space between the box part 3 and the dish portion 7.

According to the invention, the need to provide such an additional cover component is avoided if at least one and preferably both of the dish portions 5 and 7 projects beyond their associated box parts, the projecting edge of the one (upper) dish portion 7 being shaped so that in the open condition of the box it lies within a very short distance of the projecting edge of the other (lower) dish portion 5 and, in the closed condition of the box, becomes positioned in a free space between the other box part and the associated dish portion. In this embodiment the two dish portions 5 and 7 include projecting edges 35 and 37 which extend beyond respective box parts over the lengths 31 and 33. Said projecting edges 35 and 37 are shaped so that in the open condition of the box, and when viewed in the direction of the arrow C, they form a slot so that the braces 9 and the pivoting box edges 21 and 23 are substantially hidden. The projecting edge 37 is furthermore shaped so as to take up the location denoted by the reference 39 when the box is closed.

What we claim is:

1. A box comprising an upper box part and a lower box part pivotally connected to each other along respectively cooperating edges and movable relative to each other at such cooperating edges over a pivot angle smaller than 120°; a lower dish member secured to the interior of said lower box part and having a peripheral wall arranged vertically with respect to a bottom wall, the greater portion of the peripheral edge of said lower dish member engaging the peripheral edge of said lower box part, the peripheral wall of said lower dish member over the remainder of the periphery of said lower dish member being spaced from the opposing peripheral wall of said lower box part and extending vertically above said lower box part for a distance sufficient to conceal said pivotally connected cooperating edges from view when the box is in an open condition, the width of said vertically extending peripheral wall of said lower dish member corresponding at least to the length of said pivotally connected cooperating edges; and an upper dish member secured to the interior of said upper box part and having a peripheral wall arranged vertically with respect to a bottom wall, the greater portion of the peripheral edge of said upper dish member engaging the peripheral edge of said upper box part, the peripheral wall of said upper dish member over the remainder of the periphery of said upper dish member being spaced from the opposing peripheral wall of said upper box part and extending outwardly beyond said upper box part for a distance equivalent to that of the vertically extending wall of said lower dish member, the width of said outwardly extending peripheral wall of said upper dish member corresponding at least to the length of said pivotally connected cooperating edges, said upper dish member-upper box part spacing being less than the corresponding lower dish member-lower box part spacing, said outwardly extending peripheral wall of said upper dish member being situated a short distance from the vertically extending of the lower dish member when the box is in an open condition, and said outwardly extending peripheral wall of said upper dish member, when the box is in a closed condition, projecting into the slot-like spacing between the peripheral wall of the lower box part adjacent said pivotally connected cooperating edges and the opposing peripheral wall of the lower dish member.

* * * * *

UNITED STATES PATENT AND TRADEMARK OFFICE

CERTIFICATE OF CORRECTION

PATENT NO. : 4150779

DATED : April 24, 1979

INVENTOR(S) : HANS A. HILBRANDS

It is certified that error appears in the above—identified patent and that said Letters Patent is hereby corrected as shown below:

Column 4, line 5, insert --wall-- after "extending"

Signed and Sealed this

*Fifth* Day of *July 1983*

[SEAL]

*Attest:*

GERALD J. MOSSINGHOFF

*Attesting Officer*

*Commissioner of Patents and Trademarks*